United States Patent [19]

Yao

[11] 4,380,835

[45] Apr. 26, 1983

[54] ELECTRIC FLUSH TANK

[76] Inventor: Li-Ho Yao, No. 6, Alley 65, Ta-teh Lane, Chung Ching Rd., Taichung, Taiwan

[21] Appl. No.: 251,961

[22] Filed: Apr. 7, 1981

[51] Int. Cl.[3] ..... E03D 5/10

[52] U.S. Cl. ..... 4/406; 4/305; 4/DIG. 3

[58] Field of Search ..... 4/DIG. 3, 406, 305, 4/304

[56] References Cited

U.S. PATENT DOCUMENTS

| | | | |
|---|---|---|---|
| 1,456,196 | 5/1923 | Staats | 4/DIG. 3 |
| 2,056,087 | 9/1936 | Andrews | 4/DIG. 3 |
| 2,061,310 | 11/1936 | Kleiser, Jr. | 4/DIG. 3 |
| 2,412,452 | 12/1946 | Green | 4/DIG. 3 |
| 2,813,274 | 11/1957 | Lewis et al. | 4/DIG. 3 |
| 2,858,546 | 11/1958 | Tekenos et al. | 4/DIG. 3 |
| 3,090,967 | 5/1963 | Erhardt et al. | 4/DIG. 3 |

*Primary Examiner*—Henry K. Artis
*Attorney, Agent, or Firm*—Holman & Stern

[57] ABSTRACT

This invention relates to an electric flush tank designed for replacing the conventional mechanical flush tank, wherein a button switch attached to the outer wall of the water tank controls a solenoid which drives a connecting rod that in turn controls the water outlet. A microswitch installed on the connecting rod activates normally open switch B and forms normally open switch B normally closed switch D and a sustained circuit of said solenoid. A floating ball drives normally open switch A and normally closed switch D installed on the end of the connecting rod, in accordance with the rise and fall of water level. When the water is at its normal level, switch A is open and switch D is closed. When the water level in the tank is lowered, the switch A will part from the U-shaped channel wall and change to the closed state and the pilot light is lit up; switch D then contacts the U-shaped channel wall and changes to the open state, the solenoid becomes de-energized and the water outlet is closed for starting to supply water until the floating ball floats up and the pilot light goes out. This invention uses a floating ball to control switches A & D hitting the U-shaped channel wall to control, respectively, the pilot light and the power of the solenoid so as to control the water flush and to warn of any leak of water.

8 Claims, 4 Drawing Figures

ELECTRIC FLUSH TANK

BRIEF SUMMARY OF THE INVENTION

This invention relates to an electric flush tank, which is electrically operated, thus replacing the conventional mechanical type of flush tank.

DETAILED DESCRIPTION

Figure 1:
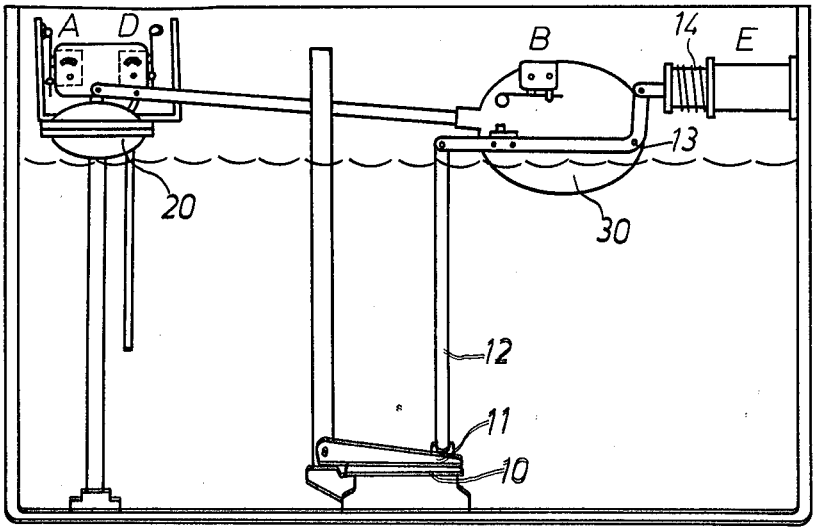
FIG. 1 is a sectional view of this invention in its normal condition.
Figure 2:
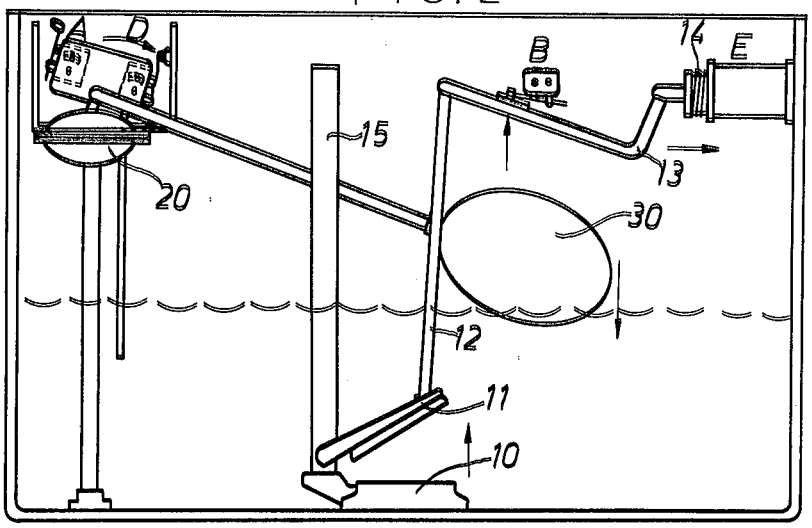
FIG. 2 is a sectional view of this invention during flushing.

This invention provides an electrically operated flush tank, which may be used to replace a conventional mechanical type of flush tank. At a suitable spot in the outer wall of the water tank, a button switch and a pilot or monitoring light are installed. The flushing valve in the water tank is controlled by a crank that is further controlled by a solenoid, and on the said crank and floating ball rod, some micro-switches are installed for controlling the flushing, storing water, and water leaking. When operating the conventional mechanical type of flush tank, one needs to push a handle located outside the water tank so as to release the flushing valve. In the conventional flushing valve, there is a small floating ball which is used for closing the flushing valve during replenishing water to the tank; however, the conventional type of flush tank is liable to have trouble because of its frequent operation, and since the repair cost is rather high, it does annoy the user from time to time. Moreover, since the conventional type of flush tank has no water-leak indicator, the noise of water leaking would annoy the user, and even worse, the leaking is not easily discovered and as a result, the figure on the monthly water bill is higher than ever. Further, the valuable water resources have unreasonably been wasted. In view of the aforesaid facts, the inventor has made some improvements on the conventional flush tank with an electric flush tank. The purpose, function and features of this invention are, together with the aid of the drawings, further described as follows:

As shown by figures, this invention mainly comprises a flush hole 10, water inlet 20, floating ball 30, microswitches A, B, D, a solenoid E, button switch C, and pilot or indicator light F. The flush hole 10 has a lid 11, of which one end is fixedly mounted, and the other end is connected with the crank 12; the crank 12 is fixed at point "13", but it can be swung up and down; also, on the crank, a contact point of microswitch B is furnished. Since the microswitch B is a normally open switch, as shown in FIG. 1, the switch is in the open state when the tank is filled with water and the flush hole closed. When flushing, as shown in FIG. 2, the crank 12 rises and contacts the switch B, causing it to revert to the "close" circuit state. Since the crank is controlled by the solenoid, whenever the solenoid is energized, it will pull the crank rightwards; then, the crank rises as shown in FIG. 2. When the switch B is in its closed state, the lid 11 is lifted upwards for flushing. When the solenoid is de-energized, the crank 12 will go downwards and leftwards as a result of the extension effect of spring 14, and the flush hole 10 will be closed; simultaneously, microswitch B will revert to its normal open state as shown in FIG. 1. Beside the flush hole 10, a pressure bleeding pipe 15 is installed for equilibrating the surface pressure of water in the tank.

Figure 3:
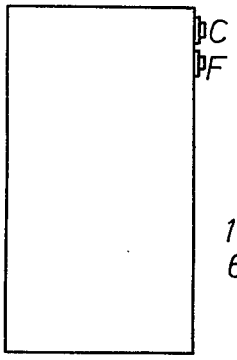
FIG. 3 is a side view of this invention.
Figure 4:
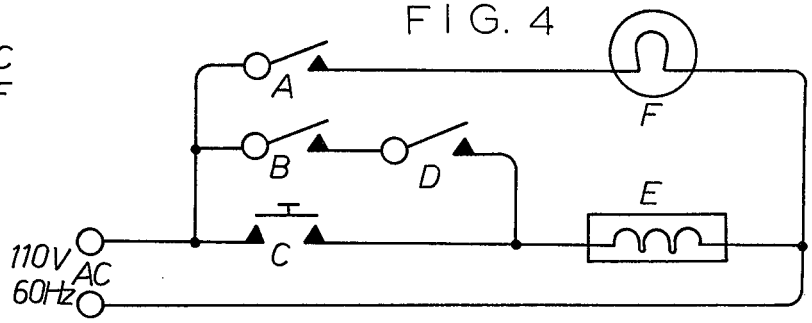
FIG. 4 is a schematic diagram of the circuit of this invention.

The water inlet 20 is a switch controlled by floating ball 30; whenever the floating ball 30 is lowered during flushing, the water inlet 20 becomes open and when the floating ball 30 rises during the process of filling the tank, the said water inlet 20 is closed. At one end of the rod, the other end of which is secured to the floating ball, there are two micoswitches A & D, which are of the normally open and normally closed type, respectively, and are installed in a U-shaped channel; since the switches are fixedly attached to the floating ball rod, they move concurrently with the floating ball rod; when the floating ball floats upwards, the microswotch A at the leftside will hit the wall of the U-shaped channel, and become open. When the floating ball floats downwards, the microswitch A reverts to its closed condition, while the switch D at the right side will hit the wall of the U-shaped channel, and become open. In this specification, the button switch C and the pilot or monitor light F are installed at a suitable spot on the water tank wall as shown in FIG. 3; however, they can also be installed at a spot other than on the water tank for remote control. With FIG. 4, further explanation on the control circuit will be given as follows:

1. Upon pushing down the button switch C, the solenoid E will be energized, and the crank will be pulled inwards to open the flush hole for flushing; simultaneously, the crank will hit the switch B, which will change to "ON" state immediately.

2. Upon the finger releasing the switch C, the power is still continuing to energize the solenoid through switches B & D, since this is a self-sustained circuit.

3. Upon the water level in tank being lowered, the switch A on floating ball rod will separate from the U-shaped channel wall, and change to the "ON" state, and the monitor light F lights up; then, the water inlet will supply water.

4. Upon the floating ball being lowered to the lowest water level, the floating ball rod will cause the switch D to press against the U-shaped channel wall, and revert to the "OFF" state.

5. The solenoid E will be de-energized because of switch D in the "OFF" position, and the spring will cause the solenoid and the lid 11 return to their normal position thereby stopping flushing.

6. Upon the water being raised to the highest level, the floating ball rod will cause the switch A to again contact the U-shaped channel wall, and the switch reverts to the "OFF" state, and the pilot light goes out; simultaneously, the switch D separates from the U-shaped channel wall and returns to the "ON" state being ready for the next flushing.

7. In case of water leaking, the water level will never reach its highest level, and the switch A will always be in the "ON" state; simultaneously, the monitor light F is always lit up to warn the user that there is something wrong.

8. By adjusting the installing angle of switch D, a lowest water level may be obtained through proper adjustment.

9. The said switch C may be installed at a spot other than in the outer wall of water tank so as to meet the specific requirements of the user by remote control. Summing up the aforesaid facts, the circuit and control parts of this invention are all installed above the water surface, therefore, they incur little difficulty in operation and do not sacrifice convenience in use; all that is necessary is to push the switch once to complete everything. It may be considered as a new and practical invention aside from its low cost in manufacturing.

I claim:

1. An electrically operated toilet flushing device comprising:

a flush tank, having a hole in its bottom;

a lid covering the hole in said tank;

a solenoid mounted within said tank;

a first lever pivotally mounted within said tank, one end of said first lever secured to said lid and the other end of said first lever attached to said solenoid;

a means for energizing said solenoid, said solenoid when achieving its energized state causing rotation of said lever;

a first switch means to maintain said solenoid in its energized state when said energizing means is released;

a second lever pivotally mounted within said tank;

a float mounted on one end of said second lever;

a water supply valve connected to a source of water and located in said tank, said valve being opened when said float is intermediate its lowermost and uppermost positions;

a second switch means for electrically de-energizing said solenoid when said float is in its lowermost position.

2. The electrically operated toilet flushing device of claim 1, wherein said first switch means for maintaining said solenoid in its energized state is located on said first lever.

3. The electrically operated toilet flushing device of claim 1, wherein said second switch means for electrically de-energizing said solenoid is located on said second lever.

4. The electrically operated toilet flushing device of claim 1, wherein a biasing means is mounted on said solenoid, said biasing means restoring said solenoid to a deactivated position when said solenoid is de-energized.

5. The electrically operated toilet flushing device of claim 1, wherein a monitor light indicating that said water supply valve is open is placed external to said tank.

6. The electrically operated toilet flushing device of claim 5, wherein a third switch means for activating said monitor light is mounted on said second lever, said light activating means being made operational when said float is below its uppermost position.

7. An electrically operated toilet flushing device of claim 1, further comprising:

a source of electrical voltage;

a first current path including said source, said energizing means and said solenoid connected in series; and a second current path including said source, said first switch means, said second switch means and said solenoid connected in series, said first switch means comprising a normally open switch which is closed in response to rotation of said first lever by energization of said solenoid, said second switch means comprising a normally closed switch which is opened in response to said float achieving its lowermost position.

8. An electrically operated toilet flushing device of claim 1, further comprising:

a monitor light provided external to said tank, said light indicating that said water supply valve is open;

a third switch means for activating said monitor light, said third switch means being mounted on said second lever; and a third current path including said source, said third switch means and said monitor light, said third switch means comprising a normally open switch which is closed in response to said float being lowered below its uppermost position.

* * * * *